US008356846B1

(12) United States Patent
Corcoran

(10) Patent No.: US 8,356,846 B1
(45) Date of Patent: Jan. 22, 2013

(54) GOLF BALL RETRIEVER

(76) Inventor: Timothy C. Corcoran, Bay, MI (US)

( * ) Notice: Subject to any disclaimer, the term of this patent is extended or adjusted under 35 U.S.C. 154(b) by 0 days.

(21) Appl. No.: 13/135,564

(22) Filed: Jul. 8, 2011

(51) Int. Cl.
*A63B 47/02* (2006.01)
*A63B 47/00* (2006.01)

(52) U.S. Cl. ..... 294/19.2

(58) Field of Classification Search ..... 294/13, 294/16, 19.2, 55, 68.24; 473/286; 56/328.1, 56/339; D21/721
See application file for complete search history.

(56) References Cited

U.S. PATENT DOCUMENTS 1,452,679 A * 4/1923 Fisher ..... 294/19.2
3,547,477 A * 12/1970 Young ..... 294/19.2
3,717,371 A * 2/1973 Halone ..... 294/19.2
4,193,625 A * 3/1980 Nelson ..... 294/19.2
4,493,503 A * 1/1985 Jeninga ..... 294/19.2
4,728,134 A * 3/1988 Allen ..... 294/19.2

* cited by examiner

*Primary Examiner* — Paul T Chin
(74) *Attorney, Agent, or Firm* — Robert L. McKellar; McKellar IP Law, PLLC

(57) ABSTRACT

The instant invention is a golf ball retriever that is comprised of a molded unitary structure. The retriever is unique because the ball passes through the bottom edge by simply placing the retriever over the ball and pressing down on the ball making the movable bales move in an upward direction. After the ball passes through the bottom edge the movable bales return to their original position and are stopped by the bale stops. This traps the ball within the confines of the ball retriever. The handle and ball receiver are locked into position by fasteners.

13 Claims, 7 Drawing Sheets

GOLF BALL RETRIEVER

This application claims priority from U.S. Utility patent application Ser. No. 12/231,448 filed Sep. 3, 2008, now abandoned.

BACKGROUND OF THE INVENTION

Golf ball retrievers are not new to the art. However, the instant invention is a unique retriever that allows the user to retrieve at least one ball at a time. The retrievers are designed to simply place the housing over a ball, or an object to be retrieved, and applying a downward pressure. Movable bales located near the bottom of the housing move upward as pressure is applied by pressing the ball. The circumference of the golf ball passes the threshold of the housing and the movable bales return to their original position with the ball entrapped within the housing.

Many prior art devices require springs to manipulate the bale. With the instant device the housing is placed over the ball, pressure is applied and the ball is entrapped within the housing. To release the ball, the user simply inverts the housing and the ball drops out. This makes the use of the instant device much simpler. This is a distinct advantage, in that, most balls are retrieved from water. The golfer does not have to directly touch the ball to remove it from the retriever. When the golfer has to manually remove the ball from prior art retrievers, the ball is already wet and possibly covered in aquatic material or mud. This causes wet hands or gloves potentially affecting play.

THE INVENTION

The instant invention is a golf ball retriever comprising in combination a housing and a telescopic handle attached to the housing.

The housing has a front wall, a rear wall and two opposing side walls. The front wall and the rear wall each have a lower edge. Each lower edge has a set of spaced-apart bales attached thereto.

Each bale has a length extending from the front wall to the rear wall and a width that when combined with the width of the opposite bale would prevent the exit of a golf ball. Each of the bales is essentially an extension of the bottom edge of each side wall without being attached to the side wall. The telescopic handle is connected to the housing and the opposite end of the handle has a gripping portion.

DETAILED DESCRIPTION OF THE DRAWINGS

Figure 1:
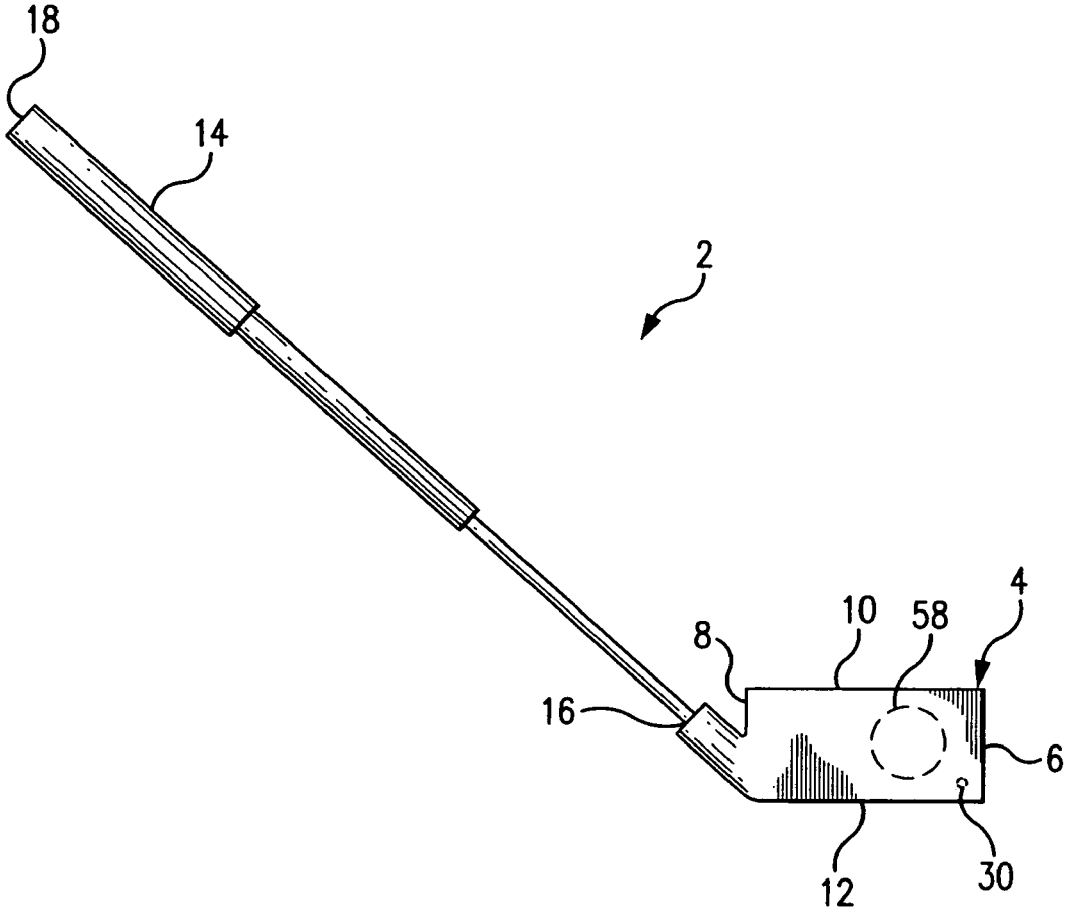
FIG. 1 is a full side view of the golf ball retriever with telescopic handle.

FIG. 1 is a full side view of the golf ball retriever 2 with telescopic handle 14. The ball receiver 4 has a near end 6 and a distal end 8. The telescopic handle 14 is attached to the ball retriever 2 at the distal end 8 of the ball retriever. The telescopic handle 14 has near end 16 and a distal end 18. The near end 16 of the handle 14 is lockably attached to the distal end 8 of the ball receiver 2. Also shown is the bale stop 30 shown in phantom against the near end wall 6. This component 30 could also be mounted on the opposite end wall.

The ball receiver 4 has a top edge 10 and a bottom edge 12. The ball retriever 2 allows the ball 58 to pass through the bottom edges 12 and become trapped within the confines of the ball receiver 4. In this Figure the ball 58 is located within the receiver 4 of the retriever 2.

Figure 2:
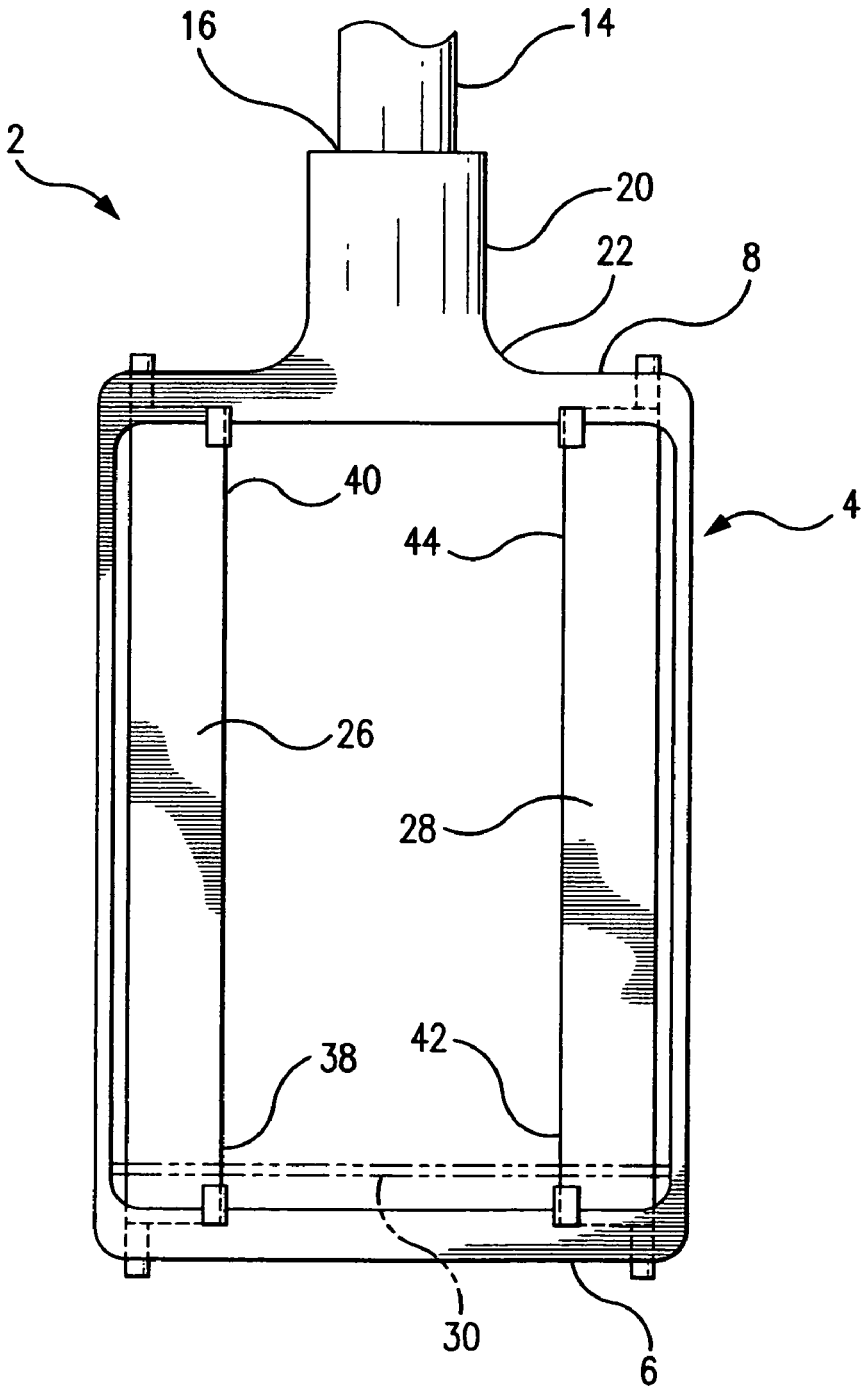
FIG. 2 is a bottom view of the golf ball retriever.

FIG. 2 is a bottom view of the golf ball retriever 2. This view better illustrates the functions of the ball retriever 2. One can observe the handle 14 and its near end 16 attached to head 20 (head attachment) at the distal end 24 of the connectors 20. The near end 22 is molded to the ball receiver 4 at its distal end 8.

The ball receiver 2 has a ball retrieving mechanism that is made up of two movable bales 26 and 28 on each opposing side of the receiver 4. The movable bale 26 and a second movable bale 28 are independent portions of the receiver 4. The first movable bale 26 has a near end 38 and a distal end 40. The second movable bale 28 also has a near end 42 and a distal end 44. The movable bales 26 and 28 move freely in an upward direction but are stopped by the bottom edge 12 from moving beyond the bottom edge 12 of ball receiver 4. This traps the ball 58 after it passes through the bottom edges 12 and retains it within the confines of the receiver 4. Also shown in this view are the first side 60 and second side 62 of the receiver 4. Also shown in phantom is the bale stop 30 which prevents the bales 26 and 28 from moving to far upward.

Figure 3:
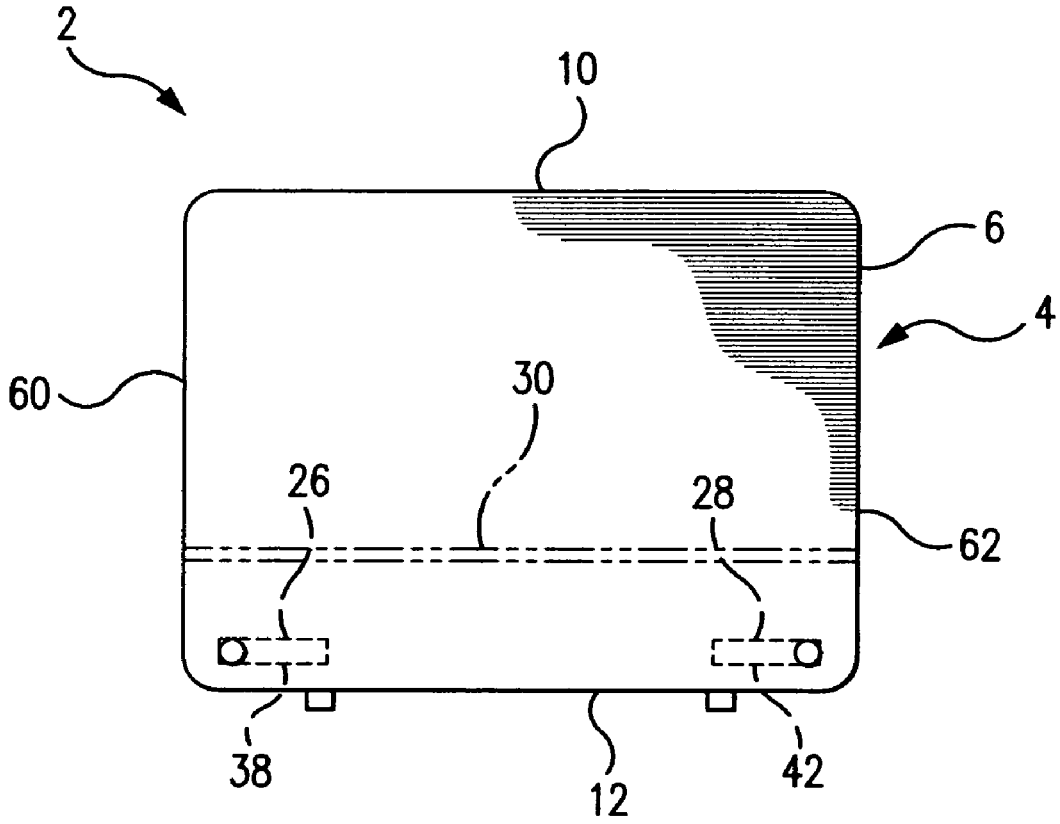
FIG. 3 is an end view of the golf ball retriever showing the movable bales.
Figure 6:
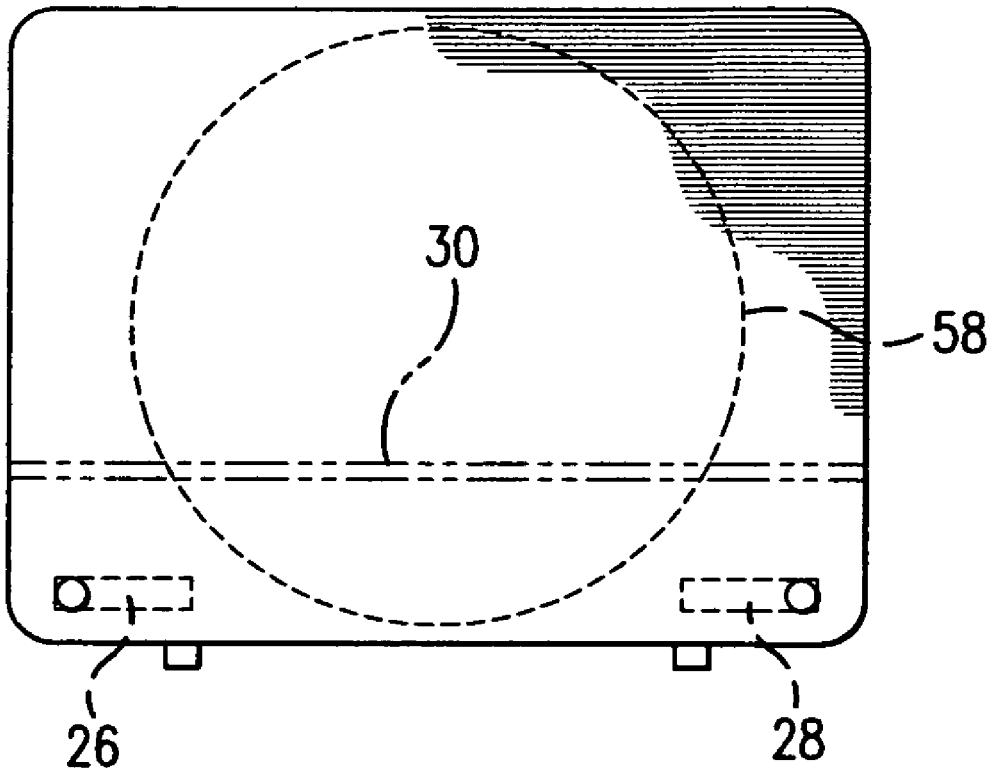
FIG. 6 is an end view of the golf ball retriever 4 showing a ball after the ball passes the threshold.

FIG. 3 is a bottom view of the golf ball retriever 2 showing the movable bales 26 and 28. This view shows the near end 6 of the ball receiver 4. The ball receiver 4 has a top edge 10, a bottom edge 12, a first side 60 and a second side 62. The first movable bale 26 and the second movable bale 28 are independent of the ball receiver 4. The near end 38 of the first movable bale 34 is shown. The near end 42 of the second movable bale 28 is also shown. The rotation of the movable bales 38 and 42 is in an upward direction. This allows the golf ball to pass into the receiver 4 and the movable bales 26 and 28 drop back to a position above the bottom edge 12 capturing the ball within the receiver 4. This is represented in FIG. 6 also. The bale stop 30 is also shown in phantom.

Figure 4:
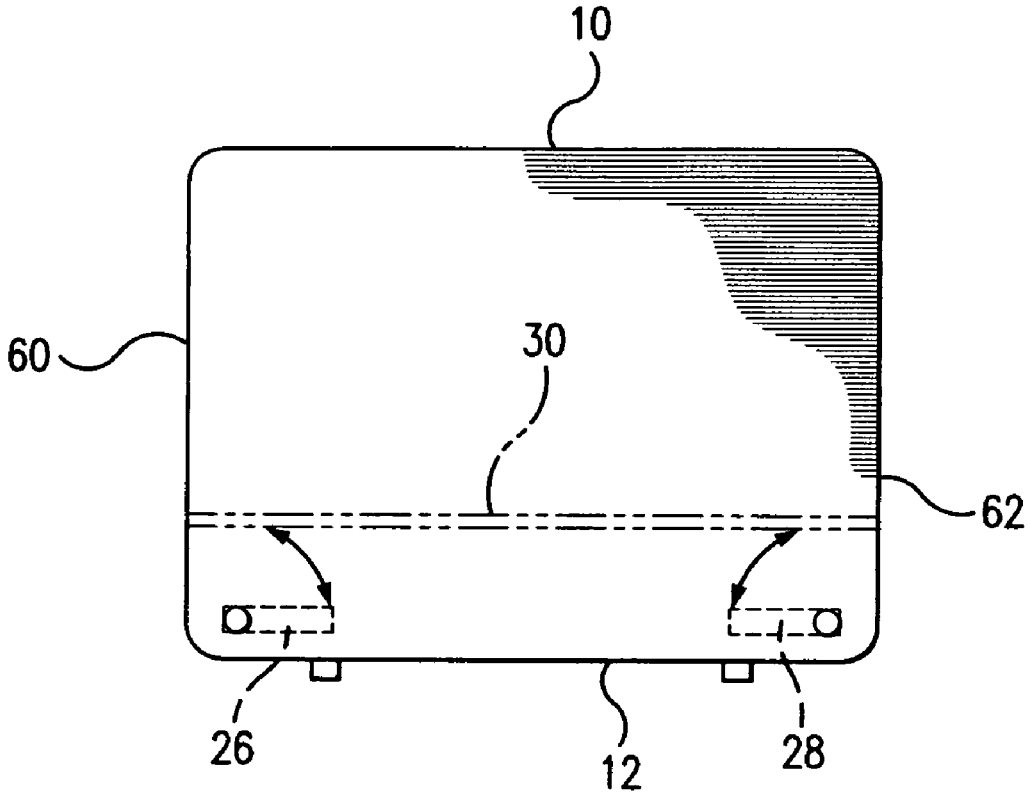
FIG. 4 is an end view of the golf ball retriever showing the direction of travel of the movable bales.

FIG. 4 is an end view of the golf ball retriever 2 showing the movable bales 26 and 28 travel direction. This view is through the distal end 8 of the ball receiver 4. The ball receiver 4 has a top edge 10, a bottom edge 12, a first side 60 and a second side 62. The first movable bale 26 and the second movable bale 28 are independent of the receiver 4. This Figure shows the direction of travel of the movable bales 26 and 28. The bale stop 30 is shown and it is clear that the movable bale 26 and 28 move freely in an upward motion allowing the ball 58 to pass through the bottom edge 12. When the ball 58 passes through the bottom edge 12 the movable bales 26 and 28 return to their original position and are stopped by the bale stops 30 trapping the ball within the receiver 4. This retains the ball 58 within the confines of the ball receiver 4.

Figure 5:
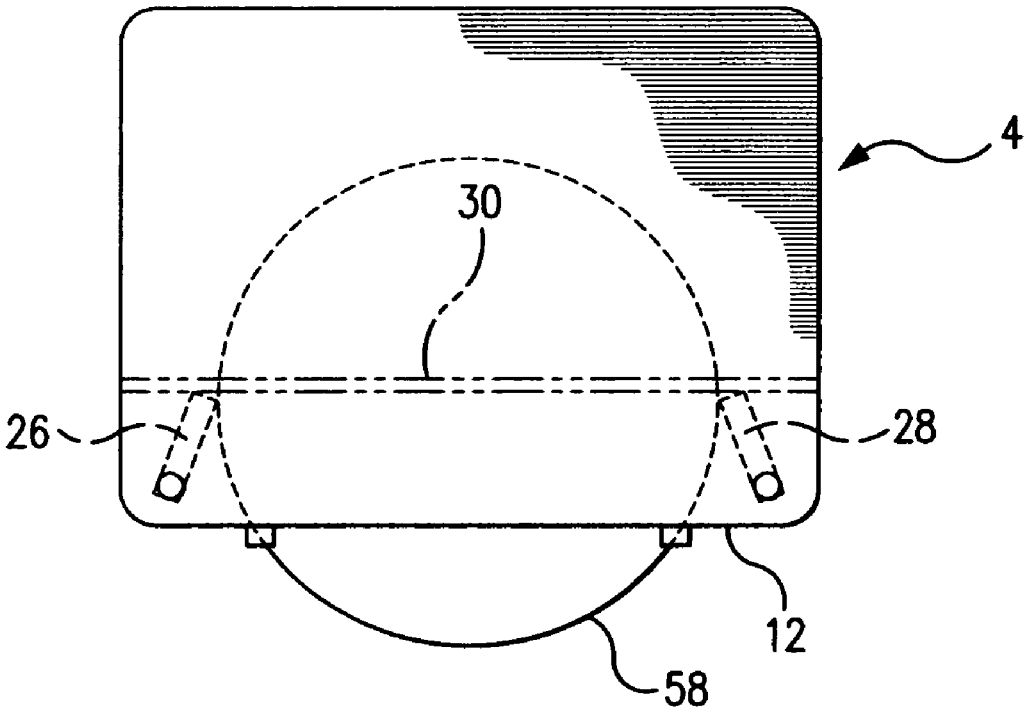
FIG. 5 shows the ball passing through the bottom edges.

FIG. 5 shows the ball 58 passing through the bottom edge 12. Both movable bales 26 and 28 move in an upward direction allowing the ball 58 to enter the ball receiver 4. The bale stop 30 prevents the bales 26 and 28 from moving too far. When the ball 58 passes over half way through the receiver 4 then the movable bales 26 and 28 return to their original position trapping the ball 58 inside the ball receiver 4.

FIG. 6 is an end view of the golf ball retriever 4 showing a ball 58 moving past the threshold. The ball 58 has been trapped within the confines of the ball receiver 4. The flexibility of the movable bales 26 and 28 has returned them to their original position against the bale stop 30.

In use the operator extends the handle 14 telescopically to reach out into hazards such as water on the golf course. Then the operator lowers the device over a ball 58, as the ball 58 forces the movable bales 26 and 28 upward, the ball 58 passes through the bottom edges 12 until the movable bales 26 and 28 allow passage of the ball 58 to the midpoint or widest portion of the receiver 4 then the mobility of the movable bales 26 and 28 force the movable bales 26 and 28 to their original position against the bale stop 30. The ball 58 is thus trapped within the confines of the ball receiver 4 and the operator moves the ball retriever 2 to a safe location and inverts the device 2 thus freeing the ball 58.

Figure 7:
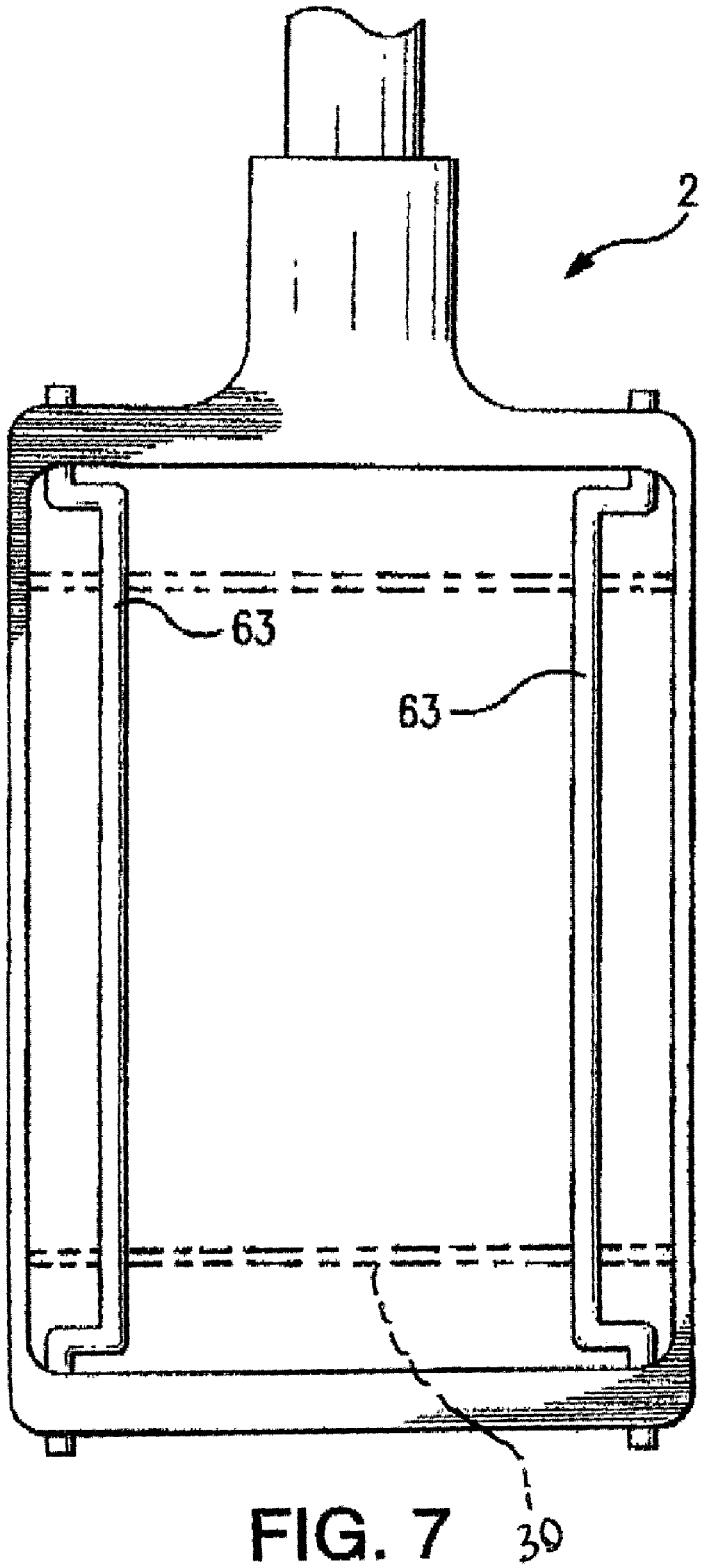
FIG. 7 is a full top view of the golf ball retriever showing wire bales.

The main embodiment shows the bales 26 and 28 as metal flaps that allow the ball to pass through. Another embodiment shows the bales as unitary pieces of metal wire 63, as is shown in FIG. 7.

What is claimed is:

1. A golf ball retriever comprising in combination:

an open bottom housing;

a telescopic handle detachedly fixed to said housing;

said housing having a front wall, a rear wall and two opposing side walls;

said front walls and said rear walls each having a lower edge, said each lower edge having a set of spaced-apart bales attached thereto;

each said bales having a length extending from said front wall to said rear wall and a width that when combined with the width of the opposite said bale prevents the exit of a golf ball;

each said bale being an extension of, but not attached to, said bottom edge of each said side wall;

each said bale extending beyond said open bottom housing such that each said bale rests on said lower edge of said front walls and said rear walls;

at least one of said front wall and said rear wall having a bale stop located near the said lower edge wherein said bales stop prevents the bales moving upward too far and also causes to return to their original position trapping the ball inside said housing;

said telescopic handle being connected to said housing and the opposite end of said telescopic handle having a gripping portion.

2. A golf ball retriever as claimed in claim 1 wherein said handle is fixed.

3. A golf ball retriever as claimed in claim 1 wherein said handle is extendable and lockable.

4. A golf ball retriever as claimed in claim 1 wherein said housing is large enough for at least one golf ball.

5. A golf ball retriever as claimed in claim 1 wherein said handle has variable lengths.

6. A golf ball retriever as claimed in claim 1 wherein said receiver is manufactured from plastic.

7. A golf ball retriever as claimed in claim 1 wherein said head attachment is fixed.

8. A golf ball retriever as claimed in claim 1 wherein said head attachment is rigidly attached.

9. A golf ball retriever as claimed in claim 1 wherein said head attachment is a snapping lock.

10. A golf ball retriever as claimed in claim 1 wherein said head attachment is attached by adhesion.

11. A golf ball retriever as claimed in claim 1 wherein said all components are a molded unitary device.

12. A golf ball retriever as claimed in claim 1 wherein said head attachment is attached by fasteners.

13. A golf ball retriever as claimed in claim 1 wherein each bale is a unitary piece of metal wire.

* * * * *